US008515309B2

(12) United States Patent
Takagi et al.

(10) Patent No.: US 8,515,309 B2
(45) Date of Patent: Aug. 20, 2013

(54) PROCESS CARTRIDGE, DEVELOPING CARTRIDGE AND IMAGE FORMING APPARATUS

(75) Inventors: Takeyuki Takagi, Nagoya (JP); Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 297 days.

(21) Appl. No.: 12/976,744

(22) Filed: Dec. 22, 2010

(65) Prior Publication Data

US 2011/0158682 A1 Jun. 30, 2011

(30) Foreign Application Priority Data

Dec. 25, 2009 (JP) ..... 2009-294587
Dec. 25, 2009 (JP) ..... 2009-294588

(51) Int. Cl.
*G03G 21/16* (2006.01)

(52) U.S. Cl.
USPC ..... 399/111

(58) Field of Classification Search
USPC ..... 399/110, 111
See application file for complete search history.

(56) References Cited

U.S. PATENT DOCUMENTS 5,678,125 A 10/1997 Kutsuwada et al.
5,815,767 A 9/1998 Kutsuwada et al.
6,009,288 A 12/1999 Akutsu
6,330,410 B1 12/2001 Okabe et al.
7,035,568 B2 4/2006 Sato et al.
7,280,784 B2 10/2007 Manabe
7,369,792 B2 5/2008 Shiraki
7,386,253 B2 6/2008 Ishii et al.
7,412,188 B2 8/2008 Ishii et al.
7,450,882 B2 11/2008 Shiraki
7,522,859 B2 4/2009 Ishii et al.

(Continued)

FOREIGN PATENT DOCUMENTS

CN 1854935 A 11/2006
JP H04-291276 A 10/1992

(Continued)

OTHER PUBLICATIONS

Japan Patent Office, Notification of Reason for Refusal for Japanese Patent Application No. 2009-294587, dispatched Oct. 25, 2011.

(Continued)

*Primary Examiner* — Walter L Lindsay, Jr.
*Assistant Examiner* — Frederick Wenderoth
(74) *Attorney, Agent, or Firm* — Baker Botts L.L.P.

(57) ABSTRACT

A developing cartridge includes: a housing that rotatably supports a developing roller; and a plurality of conveyance guide members, which are arranged along an axial direction of the developing roller and parallel to each other on an outer side of the housing, and which guide a recording medium along a conveyance path. The conveyance guide members include: conveyance ribs extend in a conveyance direction of the recording medium orthogonal to the axial direction of the developing roller so as to protrude from the housing toward the conveyance path of the recording medium; and end ribs, which are provided at both end portions in the axial direction of the developing roller, which are inclined outward with respect to the axial direction of the developing roller toward a downstream side in the conveyance direction, and which protrude further from the housing into the conveyance path side than the conveyance ribs.

17 Claims, 10 Drawing Sheets

(56) References Cited

U.S. PATENT DOCUMENTS

| | | | | |
|---|---|---|---|---|
| 7,565,092 | B2 | 7/2009 | Shiraki | |
| 7,639,967 | B2 | 12/2009 | Kamimura | |
| 7,924,299 | B2 | 4/2011 | Kishi | |
| 2004/0022555 | A1 | 2/2004 | Sato et al. | |
| 2006/0029418 | A1 | 2/2006 | Ishii et al. | |
| 2006/0029419 | A1 | 2/2006 | Shiraki | |
| 2006/0029420 | A1 | 2/2006 | Ishii et al. | |
| 2006/0029421 | A1 | 2/2006 | Ishii et al. | |
| 2006/0029422 | A1 | 2/2006 | Shiraki | |
| 2006/0029423 | A1 | 2/2006 | Shiraki | |
| 2006/0051130 | A1 | 3/2006 | Manabe | |
| 2006/0238599 | A1 | 10/2006 | Kishi et al. | |
| 2007/0048008 | A1 | 3/2007 | Kamimura | |
| 2009/0169248 | A1 * | 7/2009 | Ishii et al. | 399/111 |
| 2009/0269113 | A1 | 10/2009 | Ogawa | |
| 2010/0209125 | A1 | 8/2010 | Kishi et al. | |
| 2010/0239305 | A1 | 9/2010 | Takagi | |

FOREIGN PATENT DOCUMENTS

| | | | |
|---|---|---|---|
| JP | H04-350880 | A | 12/1992 |
| JP | H06-179540 | A | 6/1994 |
| JP | H08-314220 | A | 11/1996 |
| JP | H09-044001 | A | 2/1997 |
| JP | H10-003246 | A | 1/1998 |
| JP | H11-157695 | A | 6/1999 |
| JP | H11-224042 | A | 8/1999 |
| JP | 2000-267549 | A | 9/2000 |
| JP | 2001-075457 | A | 3/2001 |
| JP | 2002-091187 | A | 3/2002 |
| JP | 2004-069884 | A | 3/2004 |
| JP | 2006-072178 | A | 3/2006 |
| JP | 2006-184401 | A | 7/2006 |
| JP | 2006-184502 | A | 7/2006 |
| JP | 2006-317623 | A | 11/2006 |
| JP | 2006-323427 | A | 11/2006 |
| JP | 2007-057646 | A | 3/2007 |
| JP | 2009-263103 | A | 11/2009 |

OTHER PUBLICATIONS

Japan Patent Office, Notification of Reasons for Refusal for Japanese Patent Application No. 2009-294588, dispatched Oct. 18, 2011.

Japan Patent Office, Decision to Grant a Patent for Japanese Patent Application No. 2009-294588, dated May 22, 2012.

The State Intellectual Property Office of the People's Republic of China, Notification of First Office Action for Chinese Patent Application No. 201010623070.4, issued Jun. 12, 2012.

* cited by examiner

PROCESS CARTRIDGE, DEVELOPING CARTRIDGE AND IMAGE FORMING APPARATUS

CROSS-REFERENCE TO RELATED APPLICATIONS

This application claims priority from Japanese Patent Application No. 2009-294587 filed on Dec. 25, 2009 and Japanese Patent Application No. 2009-294588 filed on Dec. 25, 2009, the entire subject matter of which is incorporated herein by reference.

TECHNICAL FIELD

Apparatuses and devices consistent with the invention relate to a process cartridge that is provided to an image forming apparatus such as laser printers, a developing cartridge that is provided to the process cartridge and an image forming apparatus including the process cartridge.

BACKGROUND

As an image forming apparatus, there is known a printer having a process cartridge that is detachably mounted to the printer. The process cartridge includes a drum cartridge keeping a photosensitive drum and a developing cartridge keeping a developing roller and being detachably mounted to the drum cartridge.

As the developing cartridge provided to the printer, there is suggested a developing cartridge that is detachably mounted to a photosensitive cartridge storing a photosensitive drum. The developing cartridge includes a housing that forms a conveyance path of a sheet between a bottom wall of the photosensitive cartridge and the developing cartridge when the developing cartridge is mounted to the photosensitive cartridge.

Further, as the process cartridge provided to the printer, there is suggested a process cartridge forming a conveyance path of a sheet between a bottom wall of a photosensitive cartridge keeping a photosensitive drum and a bottom wall of a developing cartridge having a developing roller.

SUMMARY OF THE INVENTION

However, according to the related-art developing cartridge, when a sheet is out of line in the left-right direction (width direction of the sheet) during the conveyance of the sheet, the sheet contacts a member provided at a widthwise outer side of the conveyance path, so that the sheet becomes jammed between the member and the bottom wall of the photosensitive cartridge.

This problem becomes worse as the developing cartridge is made to be thinner.

Additionally, in the related-art developing cartridge, it may be considered to form ribs for guiding a conveyed sheet at a part of a housing opposed to a bottom wall of a photosensitive cartridge.

However, even in such a structure, the sheet may become jammed between the member and the bottom wall of the photosensitive cartridge as the developing cartridge is made to be thinner.

In other words, as it has recently been required to make a main body of the printer thin, the process cartridge is also made to be thin. When the process cartridge is made to be thin, the sheet conveyance path between the developing cartridge and the photosensitive cartridge becomes narrow. In this case, the sheet is likely to contact the member provided at a widthwise outer side of the conveyance path.

Further, according to the related-art process cartridge, the bottom wall of the developing cartridge is arranged in such a way that the bottom wall is covered by the bottom wall of the photosensitive cartridge.

Thus, the process cartridge becomes larger due to the conveyance path formed between the bottom wall of the photosensitive cartridge and the bottom wall of the developing cartridge. As a result, it is difficult to make the image forming apparatus thin.

Accordingly, one of the illustrative aspects of the invention provides a developing cartridge that can convey a recording medium even when the recording medium is out of line in a width direction, and a process cartridge including the developing cartridge.

Further, another one of the illustrative aspects of the invention provides a process cartridge capable of making an image forming apparatus thin, a developing cartridge provided to the process cartridge and an image forming apparatus having the process cartridge.

According to one illustrative aspect of the invention, there is provided a developing cartridge comprising: a housing that rotatably supports a developing roller; and a plurality of conveyance guide members, which are arranged along an axial direction of the developing roller and parallel to each other on an outer side of the housing, and which guide a recording medium along a conveyance path, wherein the conveyance guide members comprise: conveyance ribs extend in a conveyance direction of the recording medium orthogonal to the axial direction of the developing roller so as to protrude from the housing toward the conveyance path of the recording medium; and end ribs, which are provided at both end portions in the axial direction of the developing roller, which are inclined outward with respect to the axial direction of the developing roller toward a downstream side in the conveyance direction, and which protrude further from the housing into the conveyance path side than the conveyance ribs.

According to another illustrative aspect of the invention, there is provided a process cartridge comprising: an image carrier that carries a developer image; a transfer member, which is opposed to the image carrier, and which transfers a developer image to a recording medium; and the developing cartridge, wherein the conveyance guide member guides the recording medium between the image carrier and the transfer member.

According to still another illustrative aspect of the invention, there is provided a developing cartridge comprising: a housing that rotatably supports a developing roller; at least one conveyance rib, which protrudes from and extends along an outer side of the housing, and which extends substantially perpendicular to an axis of rotation of the developing roller, to guide a recording medium along the housing; and at least one end rib, which protrudes from an outer side of the housing, and which is located on a portion of the housing located near an axial end of the developing roller, wherein the at least one end rib is inclined at an angle with respect to the axis of rotation of the developing roller so as to approach the axial end of the developing roller as a downstream edge of the housing is approached, and wherein the at least one end rib protrudes further from the housing than the at least one conveyance rib.

According to still another illustrative aspect of the invention, there is provided a process cartridge comprising: an image carrier cartridge comprising: an image carrier, which is located at one end of the image carrier cartridge, and which carries a developer image; and a transfer member, which is opposed to the image carrier, and which transfers the developer image to a recording medium; and a developing cartridge comprising a developer carrier, which is located at one end of the developing cartridge and which carries developer, wherein the developing cartridge is detachably provided to the image carrier cartridge so that the image carrier and the developer carrier are opposed to each other, wherein the image carrier cartridge further comprises: a conveyance member that conveys the recording medium between the image carrier and the transfer member; and a first guide member, which is arranged at an interval downstream from the conveyance member in the conveyance direction of the recording medium, and which guides the recording medium conveyed by the conveyance member between the image carrier and the transfer member, wherein the developing cartridge further comprises a second guide member which, when the developing cartridge is mounted to the image carrier cartridge, cooperates with the first guide member to guide the recording medium conveyed by the conveyance member between the image carrier and the transfer member, wherein the second guide member comprises: a first guide part that is arranged between the conveyance member and the first guide member in the conveyance direction when the developing cartridge is mounted to the image carrier cartridge; and a second guide part, which is continuous with the first guide part and is located at the downstream side of the first guide part in the conveyance direction, and which is arranged to be opposite to the first guide member separated by an interval in a direction orthogonal to the conveyance direction when the developing cartridge is mounted to the image carrier cartridge, and wherein when the recording medium is conveyed by the conveyance member, the second guide member first brings the recording medium into contact with the first guide part and then the first guide part guides the recording medium between the second guide part and the first guide member.

According to still another illustrative aspect of the invention, there is provided an image forming apparatus comprising: the process cartridge; and a body casing, which houses the process cartridge, and which forms a conveyance path of a recording medium together with the process cartridge.

According to still another illustrative aspect of the invention, there is provided a developing cartridge that can be detachably provided to an image carrier cartridge comprising an image carrier carrying a developer image and a conveyance roller conveying a recording medium to the image carrier, the developing cartridge comprising: a housing; a developer carrier, which is supported by the housing, and which carries developer; and a plurality of conveyance ribs, which each protrude from the housing toward a conveyance path of the recording medium, and which guide conveyance of the recording medium, wherein end portions of the conveyance ribs at an upstream side in a conveyance direction of the recording medium are bent to conform to an outer circumferential surface of the conveyance roller and protrude toward the upstream side in the conveyance direction of the conveyance path.

According to the illustrative aspects of the invention, the conveyance guide member, which guides the conveyance of the recording medium, includes the end ribs. The end ribs are provided at both axial end portions of the developing roller. The end ribs are inclined toward the widthwise outer side as they are directed toward the downstream side in the conveyance direction. The end ribs are further protruded to the conveyance path than the conveyance ribs.

Accordingly, when the recording medium is out of line in the axial direction during the conveyance, the axial end portion of the recording medium first contacts the end ribs from the downstream side in the conveyance direction.

When the recording medium is further conveyed, the axial end portion of the recording medium tends to get on the end ribs. However, the end ribs are further protruded to the conveyance path than the conveyance ribs. Therefore, the recording medium is gradually corrected toward the conveyance path as the recording medium is directed toward the downstream side in the conveyance direction.

As the recording medium is further directed toward the downstream side in the conveyance direction, the axis end portion of the recording medium gets out of the end ribs, and thus the recording medium is guided to the normal conveyance path.

Thereby, it is possible to prevent the axial end portion of the recording medium from contacting the member that is provided at the axially outer side of the conveyance path.

As a result, even when the recording medium is out of line in the axial direction, the recording medium can be conveyed.

According to the illustrative aspects of the invention, the process cartridge includes the above developing cartridge.

Thus, it is possible to prevent the recording medium from contacting the member provided at the axially outer side of the conveyance path and to securely guide the recording medium toward between the image carrier and the transfer member.

According to the illustrative aspects of the invention, the second guide member includes the first guide part and the second guide part. The first guide part is arranged between the conveyance member and the first guide member in the conveyance direction when the developing cartridge is mounted to the image carrier cartridge. The second guide part is continuously provided to the first guide part at the downstream side in the conveyance direction. The second guide part is arranged to be opposite to the first guide member at an interval in a direction orthogonal to the conveyance direction when the developing cartridge is mounted to the image carrier cartridge.

When the recording medium is conveyed by the conveyance member, the second guide member first brings the recording medium into contact with the first guide part and then guides the recording medium between the second guide part and the first guide member by the first guide part.

Therefore, it is possible to convey the recording medium between the image carrier and the developer carrier while the conveyance member and the first guide member can be arranged at an interval.

As a result, compared to a case where the first guide member is provided adjacent to the conveyance member (for example, the related-art process cartridge), it is possible to make the process cartridge smaller (thinner) between the conveyance member and the first guide member for the bottom wall of the photosensitive cartridge in the related-art process cartridge, and to make the image forming apparatus smaller.

According to the illustrative aspects of the invention, since the smaller (thinner) process cartridge is provided, the image forming apparatus can be made to be smaller.

According to the illustrative aspects of the invention, the end portions of the conveyance ribs at the upstream side in the conveyance direction of the recording medium are bent to conform to the outer circumferential surface of the conveyance roller and are protruded toward the upstream side in the conveyance direction at the conveyance path.

According thereto, when the developing cartridge is mounted to the image carrier cartridge, the recording medium conveyed by the conveyance roller contacts the conveyance roller and then immediately contacts the upstream end portion in the conveyance direction of the conveyance rib.

As a result, since it is possible to smoothly give and take the recording medium between the conveyance roller and the conveyance ribs, it is possible to prevent the recording medium from being jammed between the conveyance roller and the conveyance ribs.

BRIEF DESCRIPTION OF THE DRAWINGS

FIGS. 10A and 10B illustrate conveyance of a sheet in the process cartridge shown in FIG. 1, wherein FIG. 10A shows a state in which a rear end portion of a sheet contacts conveyance ribs, and FIG. 10B shows a state in which the rear end portion of a sheet is guided between a second guide part of the developing cartridge and a sheet conveyance guide of the drum cartridge.

DETAILED DESCRIPTION (Overall Structure of Printer)

Figure 1:
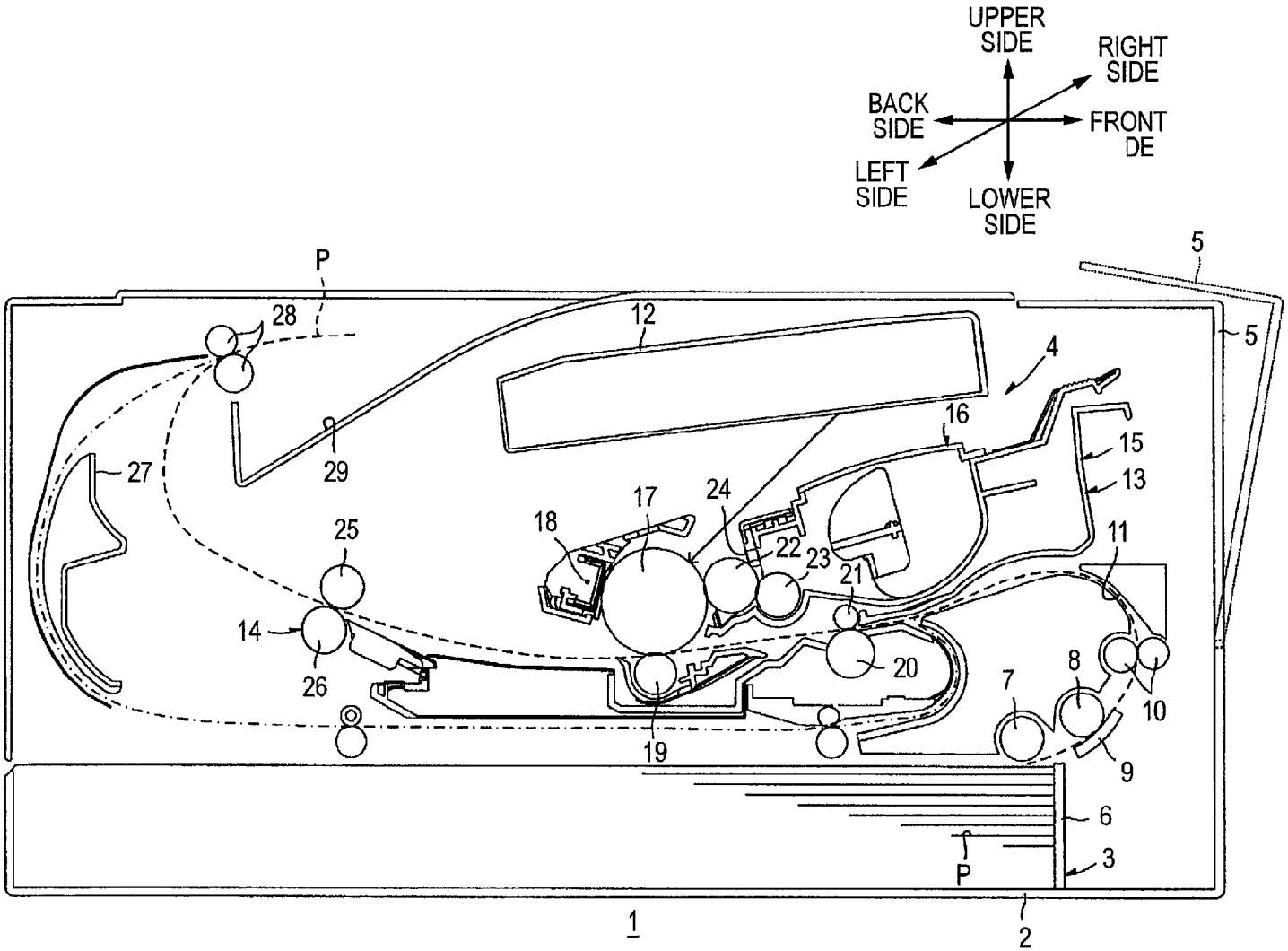
FIG. 1 is a side sectional view showing an exemplary embodiment of a printer that is an example of an image forming apparatus of the invention.

As shown in FIG. 1, a printer 1 (one example of an image forming apparatus) includes, in a body casing 2, a feeder unit 3 that feeds a sheet P (one example of a recording medium), and an image forming unit 4 that forms an image on the fed sheet P.

(1) Body Casing

The body casing 2 has a substantially rectangular box shape, when seen from a side face, for accommodating the feeder unit 3 and the image forming unit 4. A front cover 5 for attaching and detaching a process cartridge 13 (which will be described later) is formed at one sidewall of the body casing 2. The front cover 5 is provided to the body casing 2 so that the front cover 5 can be rotated about a lower end portion serving as a support point.

In the following descriptions, a side (right side in FIG. 1) to which the front cover 5 is provided is referred to as the front side and an opposite side (left side in FIG. 1) is referred to as the back side. In addition, the left and the right are assigned based on viewing the printer from the front side of the printer 1. In other words, the front side in FIG. 1 is the left and the inner side in FIG. 1 is the right.

(2) Feeder Unit

The feeder unit 3 is provided at a lower part of the body casing 2. The feeder unit 3 includes a sheet feeding tray 6 that receives sheets P, a pickup roller 7 that is provided above a front end portion of the sheet feeding tray 6, and a separation roller 8 and a separation pad 9 that are opposed to each other at the front side of the pickup roller 7. The feeder unit 3 includes a pair of front and rear feeder rollers 10 that are opposed to each other above the separation pad 9, a sheet feeding path 11 that extends from the opposite part between both feeder rollers 10 in a substantial rear-upper direction, and a main body-side register roller 20 that is arranged at the rear of the sheet feeding path 11.

The sheets P are stacked in the sheet feeding tray 6. The uppermost sheet P is fed to the opposite part between the separation roller 8 and the separation pad 9 by rotation of the pickup roller 7. The sheets are fed one at a time by the separation roller and the separation pad. Then, the sheet P passes through the sheet feeding path 11 by conveyance of the feeder rollers 10, is conveyed to a portion between the main body-side register roller 20 and a process-side register roller 21 (which will be described later), and is then conveyed toward a portion between a photosensitive drum 17 (which will be described later) and a transfer roller 19 (which will be described later) at a predetermined timing.

Incidentally, separately from the feeder unit 3, there is provided a sheet reverse device that returns the sheet P from a sheet discharge path 27 (which will be described later) toward the space between the main body-side register roller 20 and the process-side register roller 21 (which will be described later) (refer to the dotted line in FIG. 1). Therefore, it is possible to perform duplex printing.

(3) Image Forming Unit

The image forming unit 4 includes a scanner unit 12, a process cartridge 13 and a fixing unit 14.

(3-1) Scanner Unit

The scanner unit 12 is arranged at an upper part of the body casing 2. Based on image data, the scanner unit 12 emits laser beam toward the photosensitive drum 17 (which will be described later) so as to expose the photosensitive drum 17, as indicated by the solid line.

(3-2) Process Cartridge (3-2-1) Structure of Process Cartridge

The process cartridge 13 is detachably accommodated at below the scanner unit 12 and above the feeder unit 3 in the body casing 2. The process cartridge 13 includes a drum cartridge 15 (one example of an image carrier cartridge) and a developing cartridge 16 that is detachably mounted to the drum cartridge 15.

The drum cartridge 15 includes the photosensitive drum 17 (one example of an image carrier), a scorotron-type charger 18 and the transfer roller 19 (one example of a transfer member).

The photosensitive drum 17 is provided at a rear end portion of the drum cartridge 15 in the left-right direction.

The scorotron-type charger 18 is arranged to be opposite to the photosensitive drum 17 at an interval therebetween at the rear-upper side of the photosensitive drum 17.

The transfer roller 19 is arranged to be opposite to the lower side of the photosensitive drum 17 and is press-contacted to the lower side of the photosensitive drum 17.

In addition, the drum cartridge 15 includes the process-side register roller 21 (one example of a conveyance member and a conveyance roller).

The process-side register roller 21 is provided to contact the upper side of the main body-side register roller 20 at a substantially central lower end portion in the front-rear direction of the drum cartridge 15.

The developing cartridge 16 includes a developing roller 22 (one example of a developer carrier).

The developing roller 22 is rotatably supported at the rear end portion of the developing cartridge 16 so that the developing roller 22 is exposed from the rear side of the developing cartridge 16 and is press-contacted to the front side of the photosensitive drum 17.

The developing cartridge 16 includes a supply roller 23 that supplies toner to the developing roller 22 and a layer thickness regulating blade 24 that regulates a thickness of toner supplied to the developing roller 22. Toner (one example of developer) is accommodated in a space in front of the supply roller 23 and the layer thickness regulating blade 24.

(3-2-3) Developing Operation in Process Cartridge

Toner in the developing cartridge 16 is supplied to the supply roller 23 and also to the developing roller 22 and is positively friction-charged between the supply roller 23 and the developing roller 22.

A thickness of toner supplied to the developing roller 22 is regulated by the layer thickness regulating blade 24 as the developing roller 22 is rotated, and the toner is carried on a surface of the developing roller 22 as a thin layer having a predetermined thickness.

In the meantime, a surface of the photosensitive drum 17 is positively charged to be uniform by the scorotron-type charger 18 as the photosensitive drum 17 is rotated, and the surface of the photosensitive drum 17 is then exposed by high-speed scanning of the laser beam from the scanner unit 12 (refer to the solid line in FIG. 1). Thereby, an electrostatic latent image that corresponds to an image to be formed on the sheet P is formed on the surface of the photosensitive drum 17.

When the photosensitive drum 17 is further rotated, the toner, which is carried on the surface of the developing roller 22 and positively charged, is supplied to the electrostatic latent image formed on the surface of the photosensitive drum 17. Thereby, the electrostatic latent image of the photosensitive drum 17 becomes a visualized image and a toner image resulting from reversal development is carried on the surface of the photosensitive drum 17.

When the sheet P conveyed between the photosensitive drum 17 and the transfer roller 19 passes between the photosensitive drum 17 and the transfer roller 19, the toner image carried on the photosensitive drum 17 is transferred on the sheet P.

(3-3) Fixing Unit

The fixing unit 14 is arranged at the rear of the process cartridge 13 and includes a heating roller 25 and a pressing roller 26 that is opposed to the heating roller 25. In the process cartridge 13, the toner image transferred on the sheet P is heat-fixed on the sheet P by heating and pressing while the sheet P passes between the heating roller 25 and the pressing roller 26.

(4) Sheet Discharge Unit

The sheet P on which the toner image is fixed passes through the sheet discharge path 27, which includes a U-turn path, is conveyed toward the sheet discharge roller 28 and is discharged by a sheet discharge roller 28 to a sheet discharge tray 29, which is provided at the upper side of the scanner unit 12.

(Details of Process Cartridge)

(1) Drum Cartridge

Figure 2:
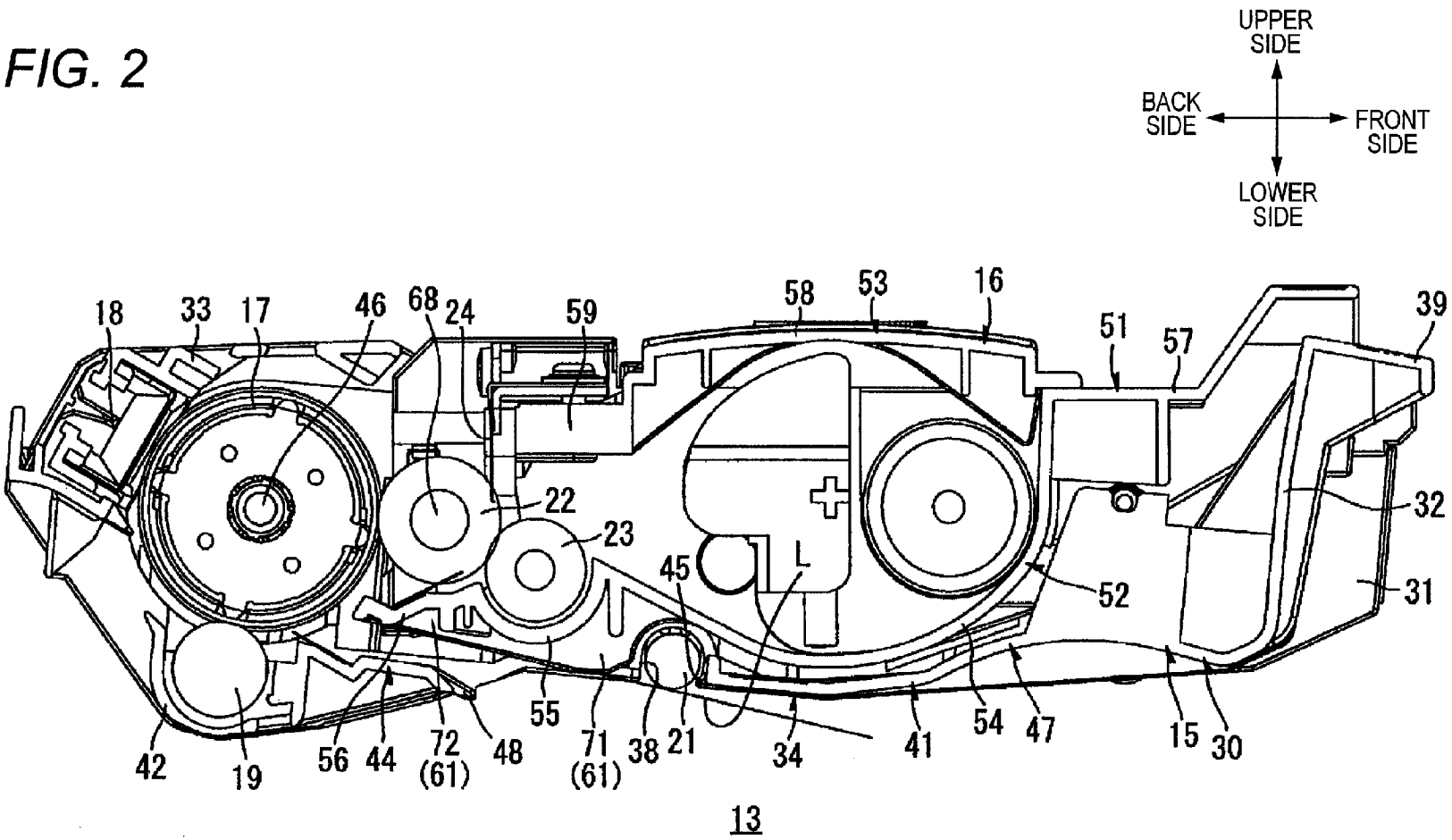
FIG. 2 is a side sectional view of a process cartridge shown in FIG. 1.
Figure 3:
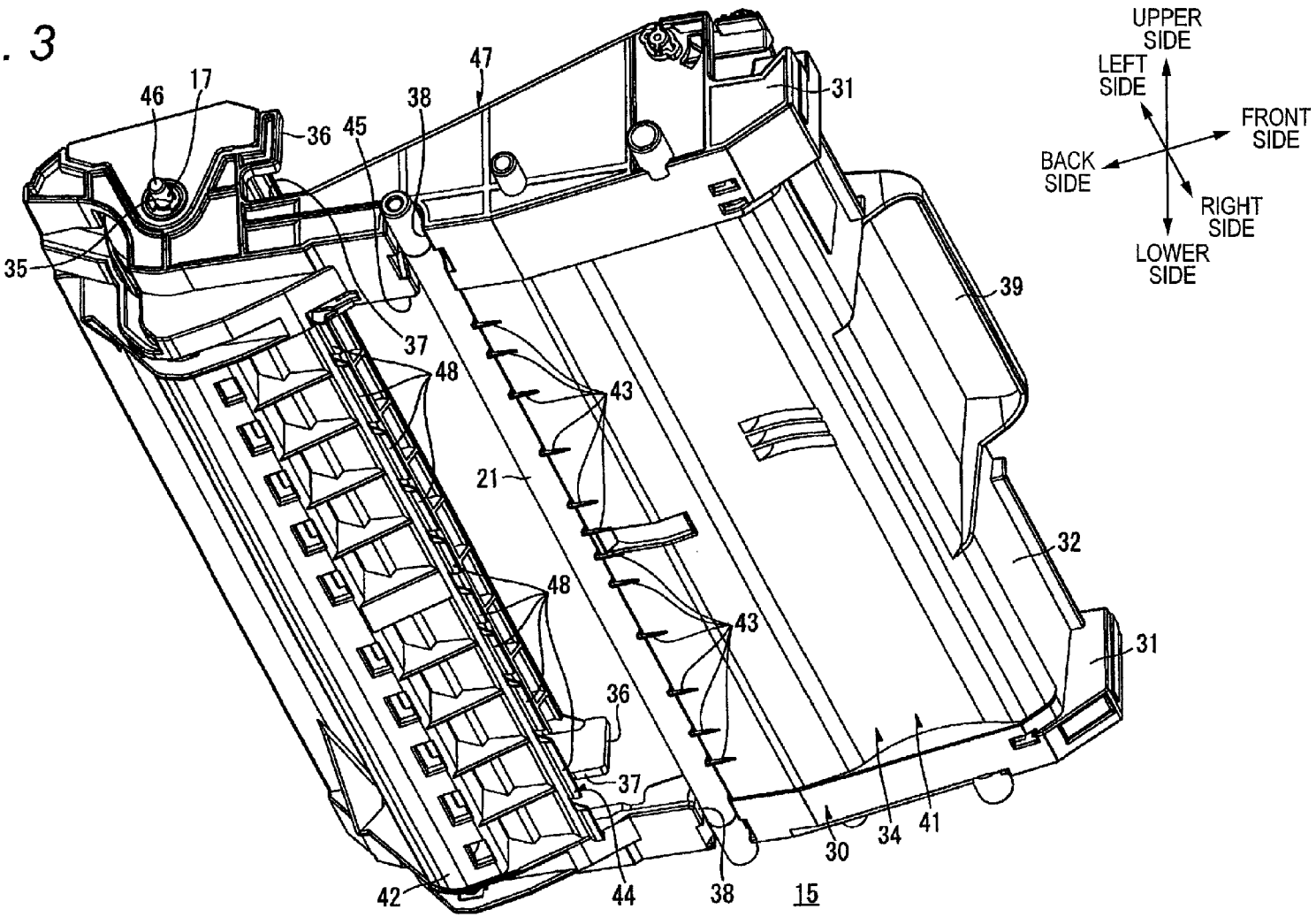
FIG. 3 is a perspective view of a drum cartridge shown in FIG. 1 as seen from a left-lower direction.

As shown in FIGS. 2 and 3, the drum cartridge 15 has a substantially rectangular frame shape and includes a drum frame 30.

The drum frame 30 includes a pair of left and right sidewalls 31, a front wall 32 disposed between front end portions of the sidewalls 31, an upper wall 33 disposed between rear-upper end portions of the sidewalls 31 and a lower wall 34 disposed between lower end portions of the sidewalls 34.

The sidewalls 31 have a substantially rectangular shape, when seen from a side face extending in a front-rear direction. In addition, the sidewalls 31 include drum shaft insertion penetration holes 35, coupling support grooves 36, developing roller support grooves 37, and register roller support grooves 38.

The drum shaft insertion penetration holes 35 penetrate the rear end portions of the sidewalls 31 in a left-right direction and have a substantially circular shape, when seen from a side face capable of receiving a drum shaft 46 of the photosensitive drum 17.

The coupling support grooves 36 have a substantial V-shape when seen from a side face having an opened upper side so that they are downward notched from upper end edges of the sidewalls 31 at an interval at front sides of the drum shaft insertion penetration holes 35.

The developing roller support grooves 37 are continued from lower-rear end portions of the coupling support grooves 36 and have a substantially rectangular shape when seen from a side face extending in the rear direction. Incidentally, rear end portions of the developing roller support grooves 37 are arranged at an interval at the front of the drum shaft insertion penetration holes 35. The developing roller support grooves 37 have respectively a groove width (a length in an upper-lower direction) that is slightly wider than an outer diameter of a collar part 67 (which will be described later) of the developing cartridge 16.

The register roller support grooves 38 have a substantial U-shape when seen from a side face having an opened lower side so that they are upward notched from the lower end portions of the sidewalls 31 at substantial centers in the front-rear direction of the sidewalls 31. In addition, the register roller support grooves 38 have a groove width (a length in a front-rear direction) that is slightly wider than a diameter of the process-side register roller 21.

The front wall 32 has a substantially rectangular shape when seen from a front face extending in the left-right direction and includes a handle 39 at a substantial center in the left-right direction thereof, which is held by a user when mounting or separating the process cartridge 13 to or from the body casing 2.

The upper wall 33 covers the photosensitive drum 17 from the upper side thereof and has a substantially rectangular shape when seen in a plan view extending in the left-right direction.

The lower wall 34 has a substantially rectangular shape when seen in a plan view extending in the front-rear and left-right direction. In addition, the lower wall 34 includes a developing cartridge support part 41 for mounting the developing cartridge 16, a transfer roller housing part 42 for receiving the transfer roller 19 and a sheet conveyance guide 44 (one example of a first guide member).

The developing cartridge support part 41 includes a front end portion connected to the lower end portion of the front wall 32 and a rear end portion that is substantially flush with front end portions of the register roller support grooves 38 in the left-right direction.

A front side part of the developing cartridge support part 41 is curves upwardly to form a recess upwardly. A back side part of the developing cartridge support part 41 is continued from a rear end portion of the front side part thereof and is downwardly inclined as it is directed toward the rear from the front. Then, the back side of the developing cartridge support part 41 has a flat plate shape that extends in the front-rear direction.

The developing cartridge support part 41 includes a plurality of guide ribs 43 at the rear end portion thereof.

Each guide rib 43 is extended in the left-right direction so that it is protrudes downward as it is directed toward the back side from the front side. The guide ribs 43 are arranged in the left-right direction in parallel.

The transfer roller housing part 42 is near an opening at the back side of the developing cartridge support part 41. The transfer roller housing part 42 is provided at the rear end portion of the drum frame 30, opens upwardly and is bent to conform to the circumferential surface of the transfer roller 19.

The sheet conveyance guide 44 is provided at the front side of the transfer roller housing part 42. The sheet conveyance guide 44 includes a front end portion that is arranged at an opening at the back side of the developing cartridge support part 41 and a rear end portion that continues to the transfer roller housing part 42, and has a substantially flat plate shape extending in the left-right direction.

Figures 10A, 10B:
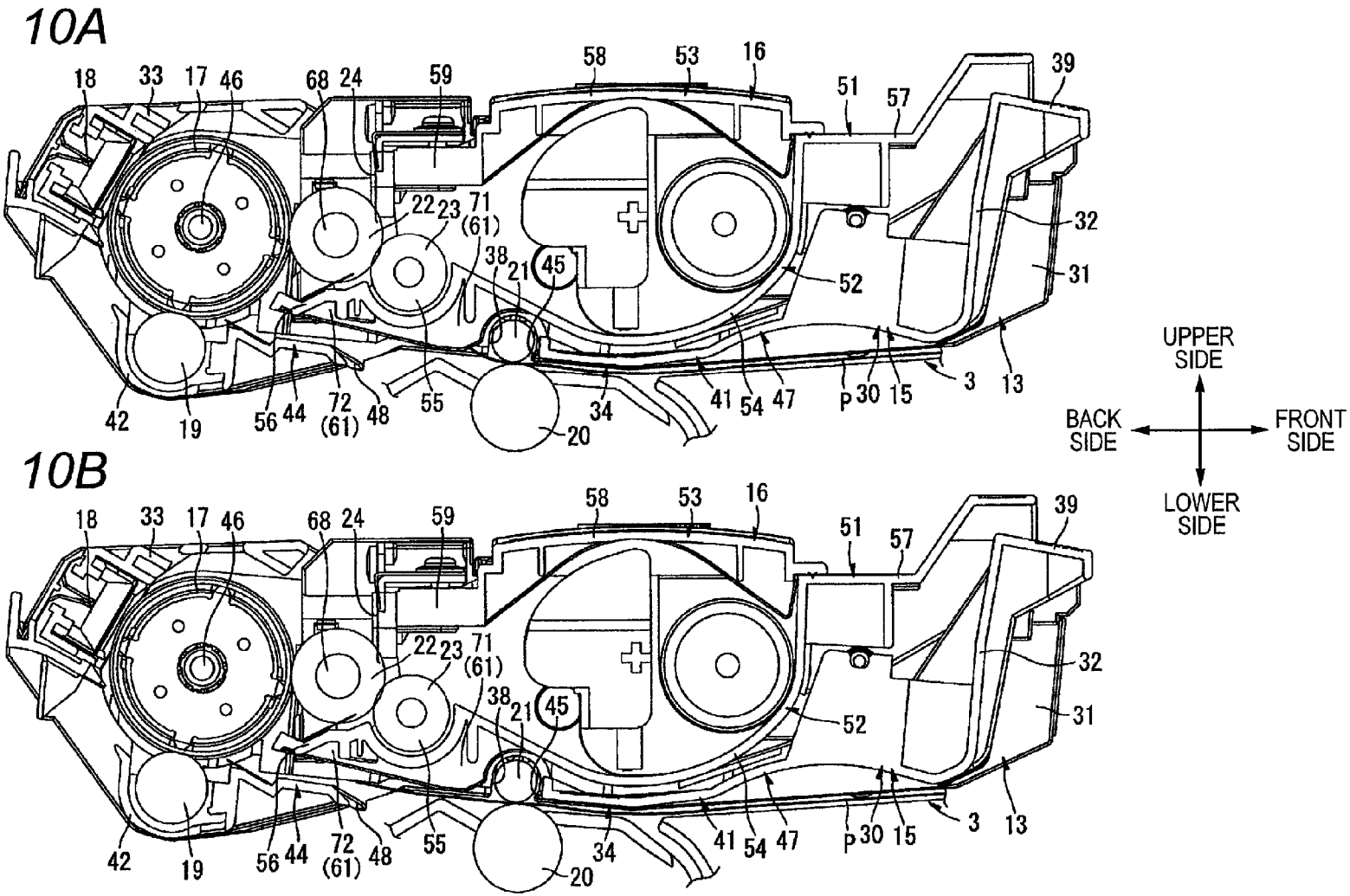

In addition, the front end portion of the sheet conveyance guide 44 opposes an upper end portion of the feeder unit 3 in the front-rear direction (refer to FIG. 10A). Further, a plurality of claw portions 48 are provided at the end portion of the sheet conveyance guide 44.

When seen from a plan view, each of the claw portions 48 has a substantially rectangular shape protruding forward from the front end portion of the sheet conveyance guide 44. The claw portions 48 are arranged in parallel at an interval in the left-right direction. Further, when seen from a side sectional view, an upper end edge of the claw portion 48 has a substantially liner shape which is upwardly inclined as toward the rear from the front. The claw portions 48 meets the sheet P, which is guided to a first guide part 71 (which will be described later) of the developing cartridge 16, between the sheet conveyance guide 44 and a second guide part 72 (which will be described later) of the developing cartridge 16 (refer to FIG. 10B).

In addition, the rear end portion of the sheet conveyance guide 44 is opposed to a nip portion between the photosensitive drum 17 and the transfer roller 19 in the front-rear direction.

The drum frame 30 includes an opening 45. The opening 45 is surrounded by the sidewalls 31, the developing cartridge support part 41 of the lower wall 34 and the sheet conveyance guide 44 of the lower wall 34. In other words, the opening 45 has a substantially rectangular shape that is long in the left-right direction between the developing cartridge support part 41 and the sheet conveyance guide 44 of the lower wall 34.

In addition, the drum cartridge 15 includes the photosensitive drum 17, the scorotron-type charger 18, the transfer roller 19 and the process-side register roller 21, as described above.

The photosensitive drum 17 includes a drum shaft 46 extending along a central axis line thereof. Both end portions in the left-right direction of the drum shaft 46 are rotatably inserted into the drum shaft insertion penetration holes 35 of the sidewalls 31 from the inner sides in the left-right direction, so that the photosensitive drum 17 is rotatably provided to the drum cartridge 15.

The scorotron-type charger 18 is supported at the front end portion of the upper wall 33. The transfer roller 19 extends in the left-right direction and is rotatably supported in the transfer roller housing part 42.

The process-side register roller 21 extends in the left-right direction and is rotatably supported in the register roller support grooves 38 of the sidewalls 31 at both end portions in the left-right direction thereof so that the process-side register roller 21 is provided at the forefront of the opening 45. In other words, the process-side register roller 21 is provided in the opening 45 in the front-rear direction.

Incidentally, in the drum cartridge 15, a developing cartridge mounting part 47 for mounting the developing cartridge 16 is defined by the sidewalls 31, the front wall 32 and the photosensitive drum 17.

(2) Developing Cartridge (2-1) Structure of Developing Cartridge

Figure 4:
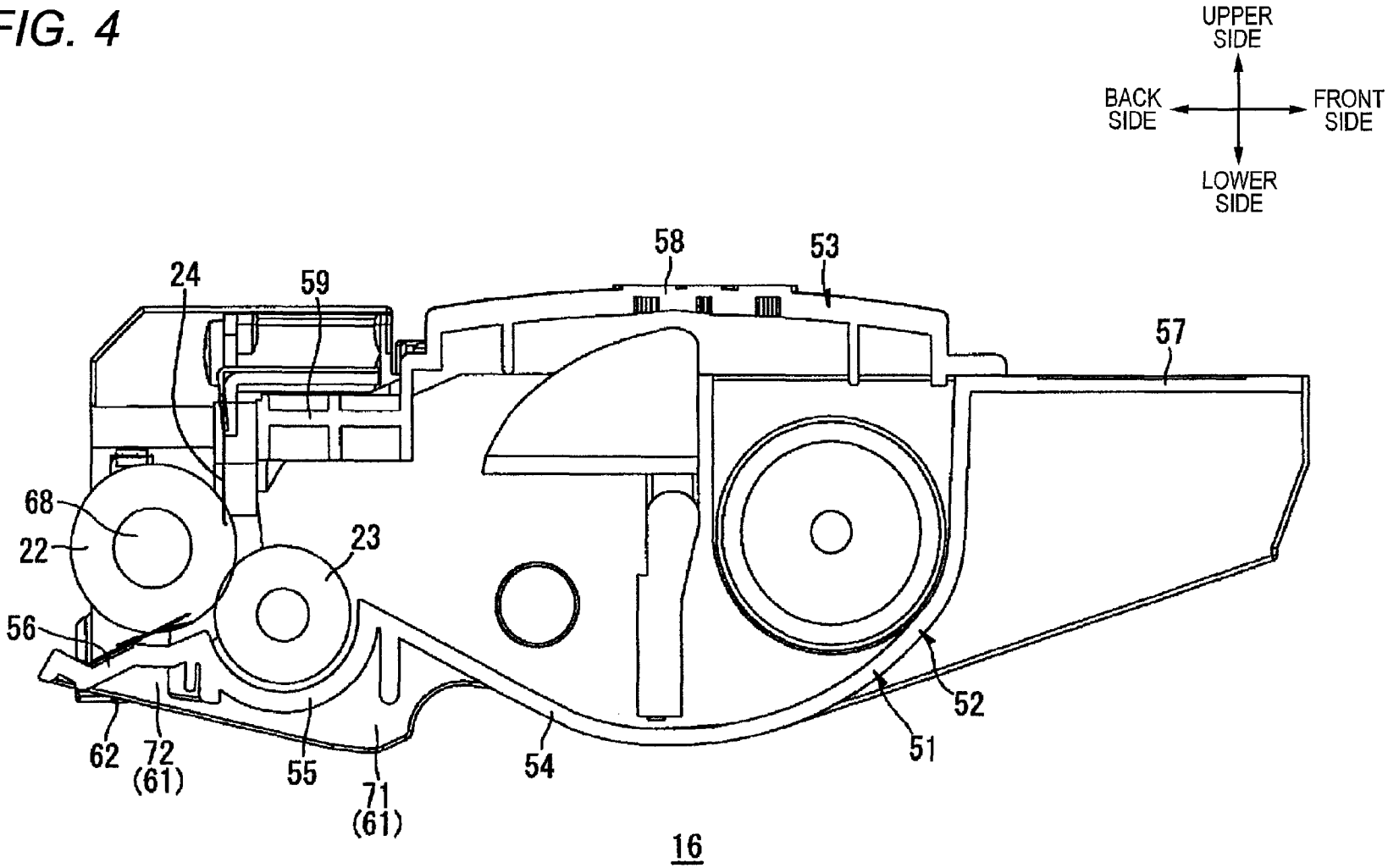
FIG. 4 is a side sectional view of a developing cartridge shown in FIG. 1.
Figure 5:
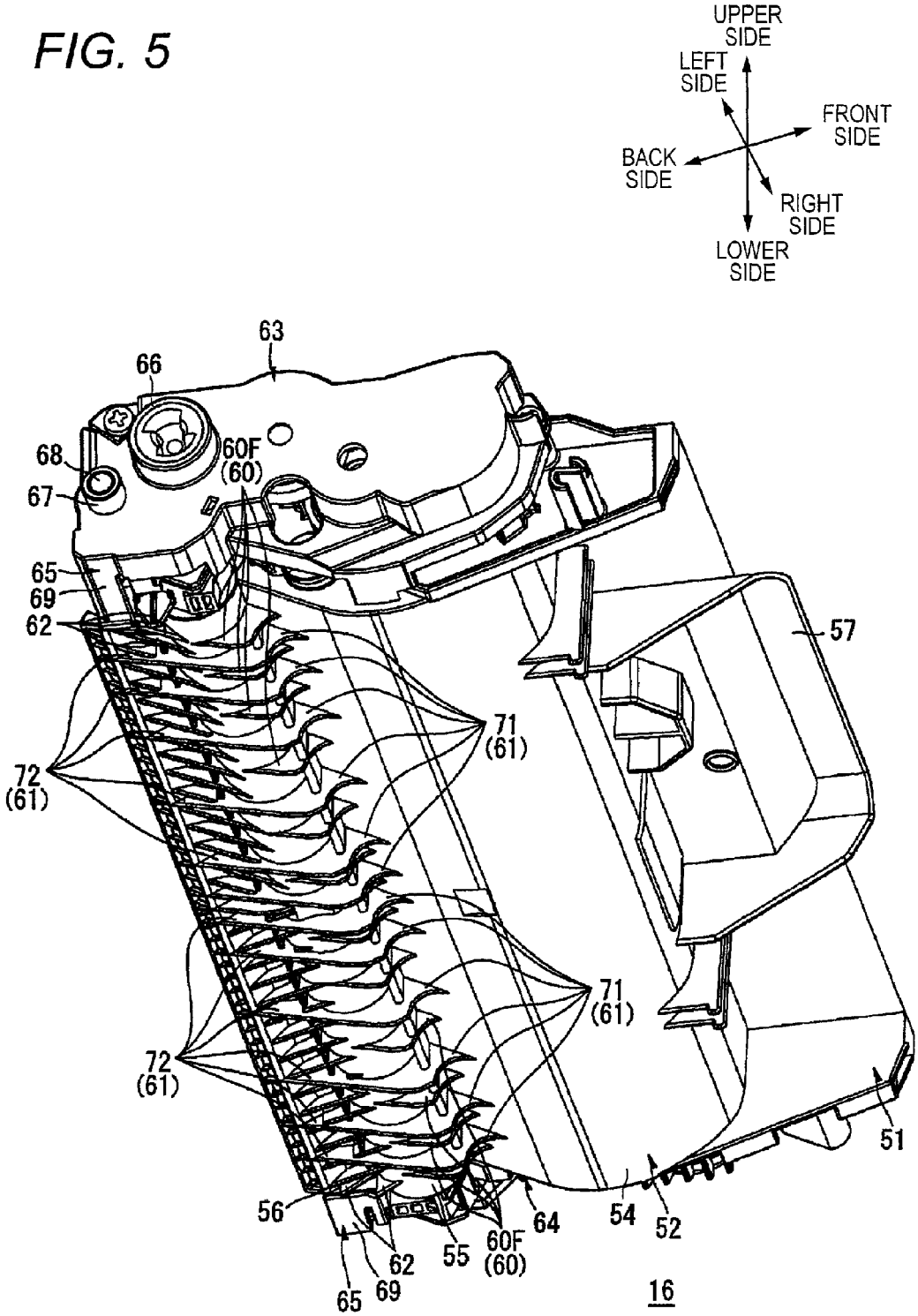
FIG. 5 is a perspective view of the developing cartridge shown in FIG. 1 as seen from a left-lower direction.

As shown in FIGS. 4 and 5, the developing cartridge 16 has a substantial box shape extending in the left-right direction and includes a developing frame 51 (one example of a housing).

The developing frame 51 has a substantial box shape extending in the left-right direction. The developing frame 51 includes a first frame 52 and a second frame 53.

The first frame 52 configures a lower side of the developing frame 51 and has a frame shape having a bottom that is opened upward and forward.

Further, the first frame 52 includes a toner accommodating part 54 that is provided at a substantial center in the front-rear direction of the first frame, a supply roller support part 55 that is provided at the rear of the toner accommodating part 54 and a developing roller support part 56 that is provided at the rear of the supply roller support part 55.

The toner accommodating part 54 has a gentle circular arc shape having an opened upper side, when seen from a side sectional view. Specifically, the toner accommodating part 54 is extends downwardly from the upper end portion of the first frame 52, is bent rearward directed toward the lower end portion thereof and then is slightly inclined in the upper direction toward the rear, when seen from a side sectional view. Toner is accommodated in the toner accommodating part 54.

The supply roller support part 55 continues from the rear end portion of the toner accommodating part 54 and has a substantial U-shape so that bends along the outer circumferential surface of the supply roller 23, when seen from a side sectional view having an opened upper side. Both end portions of the supply roller 23 in the left-right direction are rotatably supported to both sidewalls of the supply roller support part 55 in the left-right direction.

The developing roller support part 56 continues from the rear end portion of the supply roller support part 55 and has a substantially linear shape (lip shape) when seen from a side sectional view extending in the rear direction. Both end portions of the developing roller shaft 68 of the developing roller 22 in the left-right direction are rotatably supported by both sidewalls of the developing roller support part 56 in the left-right direction.

Further, the first frame 52 includes an operation part 57 that extends forward from a front upper end portion of the toner accommodating part 54. The operation part 57 is held by a user when the user operates the developing drum 16 (for example, attachment and detachment operation to and from the drum cartridge 15).

The second frame 53 configures an upper side of the developing frame 51 and has a substantially rectangular flat plate shape when seen from a plan view. The second frame 53 is combined and welded to an upper end portion of the first frame 52 from the upper side, as a closed cover.

In addition, the second frame 53 includes a toner accommodating part-covering part 58 that covers the toner accommodating part 54 of the first frame 52 from its upper side and a supply roller covering part 59 that covers the supply roller 23 from its upper side.

The toner accommodating part-covering part 58 has a substantially rectangular flat plate shape, when seen from a plan view, and has a size capable of completely covering the toner accommodating part 54 of the first frame 52. The toner accommodating part-covering part 58 closes the upper end portion of the toner accommodating part 54 of the first frame 52.

The supply roller covering part 59 has a substantially rectangular flat plate shape, when seen in a plan view extending from a rear-lower end portion of the toner accommodating part-covering part 58 toward the rear. The supply roller covering part 59 closes the upper end portion of the supply roller support part 55 of the first frame 52.

The developing cartridge 16 includes a driving unit 63 at the left side of the developing frame 51 and an electrode unit 64 at the right side of the developing frame 51. Driving force from a driving source (not shown) of the body casing 2 is input to the driving unit 63. Power from a power supply (not shown) of the body casing 2 is input to the electrode unit 64.

The driving unit 63 includes a coupling part 66, to which the driving force from the driving source (not shown) is input. The driving unit 63 transmits the driving force input to the coupling part 66 to the developing roller 22 and the supply roller 23 by a gear transmission device (not shown).

The electrode unit 64 transmits the power input to the developing roller 22 and the supply roller 23 by a wiring cable (not shown).

In addition, the developing cartridge 16 includes toner receiving members 65 at outer sides in the left-right direction of the developing roller support part 56. Incidentally, the left toner receiving member 65 is integrally provided to a rear end portion of the driving unit 63.

The toner receiving members 65 integrally include cover parts 69 that cover both end portions in the left-right direction of the developing roller 22 at the lower sides and collar parts 67 that rotatably support both end portions in the left-right direction of the developing roller shaft 68.

The cover parts 69 are opened at upper and front sides and have a substantially conical shape extending in the left-right direction. The cover parts 69 receive toner that falls down from both end portions in the left-right direction of the developing roller 22.

The collar parts 69 are provided above outer end portions in the left-right direction of the cover parts 69 are extended in the left-right direction and have a substantially cylindrical shape having an inner diameter capable of receiving the developing roller shaft 68, respectively.

(2-2) Conveyance Ribs and End Ribs

Figure 6:
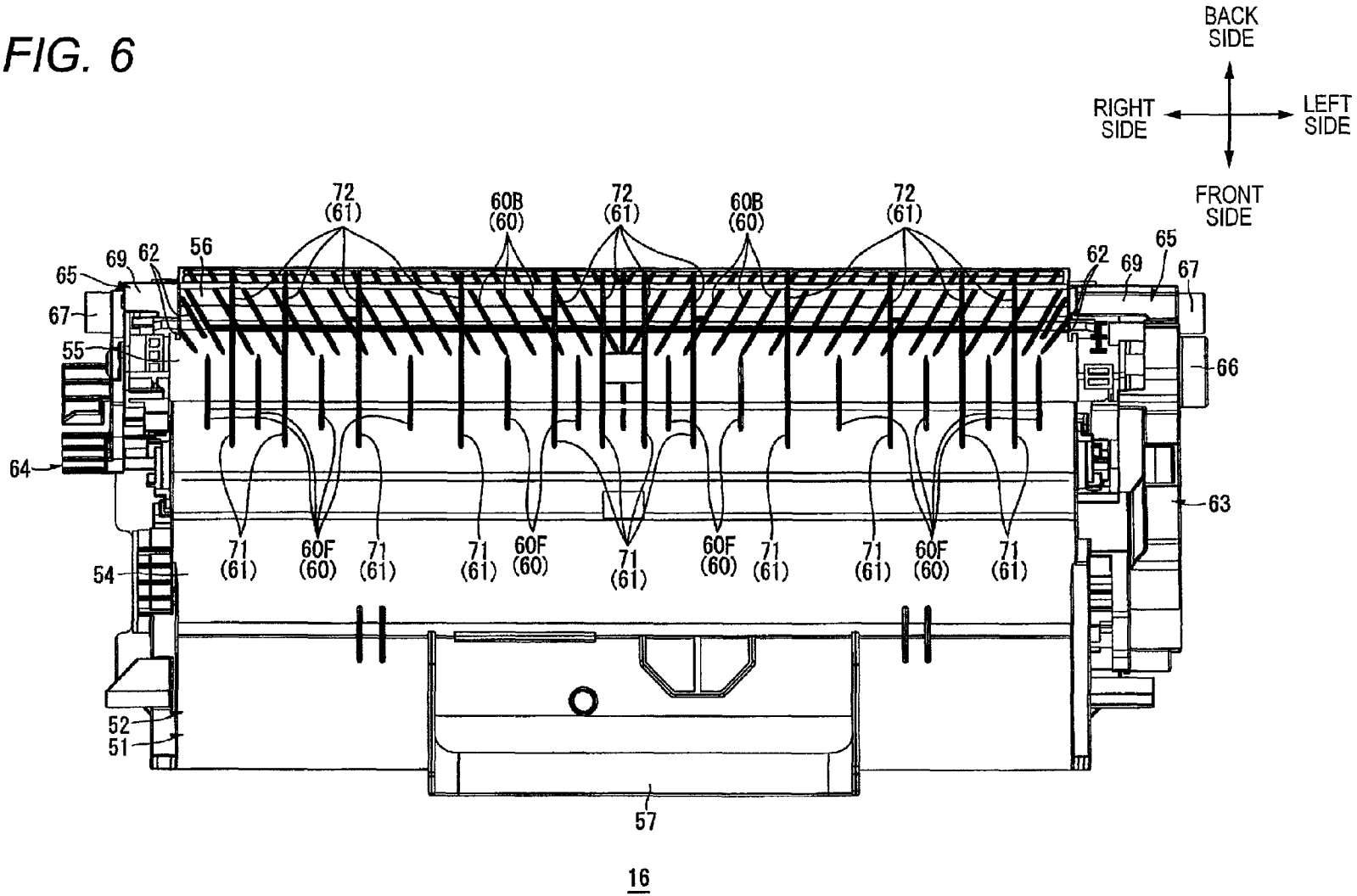
FIG. 6 is a bottom view of the developing cartridge shown in FIG. 1.

As shown in FIGS. 5 and 6, the first frame 52 includes conveyance ribs 61 (one example of a second guide member), end ribs 62 and reinforcement ribs 60, which protrude downwardly from a lower surface of the rear end portion of the first frame. In other words, the rear end portion of the first frame 52 functions as a conveyance guide member.

The conveyance ribs 61 are extended in the front-rear direction over the rear end portion of the developing roller support part 56 from the rear end portion of the toner accommodating part 54, when seen from a bottom face. The conveyance ribs 61 are provided over substantially the whole of the first frame 52 in the left-right direction and are arranged in parallel in the left-right direction.

In addition, front end edges of the conveyance ribs 61 are bent to conform to the outer circumferential surface of the process-side register roller 21, when seen from a side face.

Front-lower end edges of the conveyance ribs 61 protrude slightly in the front direction. Specifically, the protruded portions of the conveyance ribs 61 are downwardly inclined as they are directed toward the back side from the front side.

Rear-lower end edges of the conveyance ribs 61 have a substantially linear shape extending in the front-rear direction, when seen from a side face (refer to FIG. 4).

The end ribs 62 are provided in a pair in the front-rear direction at both end portions in the left-right direction of the first frame 52, respectively. The end ribs 62 in the front-rear direction are parallel arranged in substantially parallel with each other at an interval in the front-rear direction.

Each end rib 62 is arranged at an outer side of the outermost conveyance rib 61 in the left-right direction and is inclined toward an outer side in the left-right direction as it is directed toward the rear. Further, each end rib 62 protrudes slightly downwardly as it is directed toward the rear, when seen from a side face (refer to FIG. 4).

Figure 7:
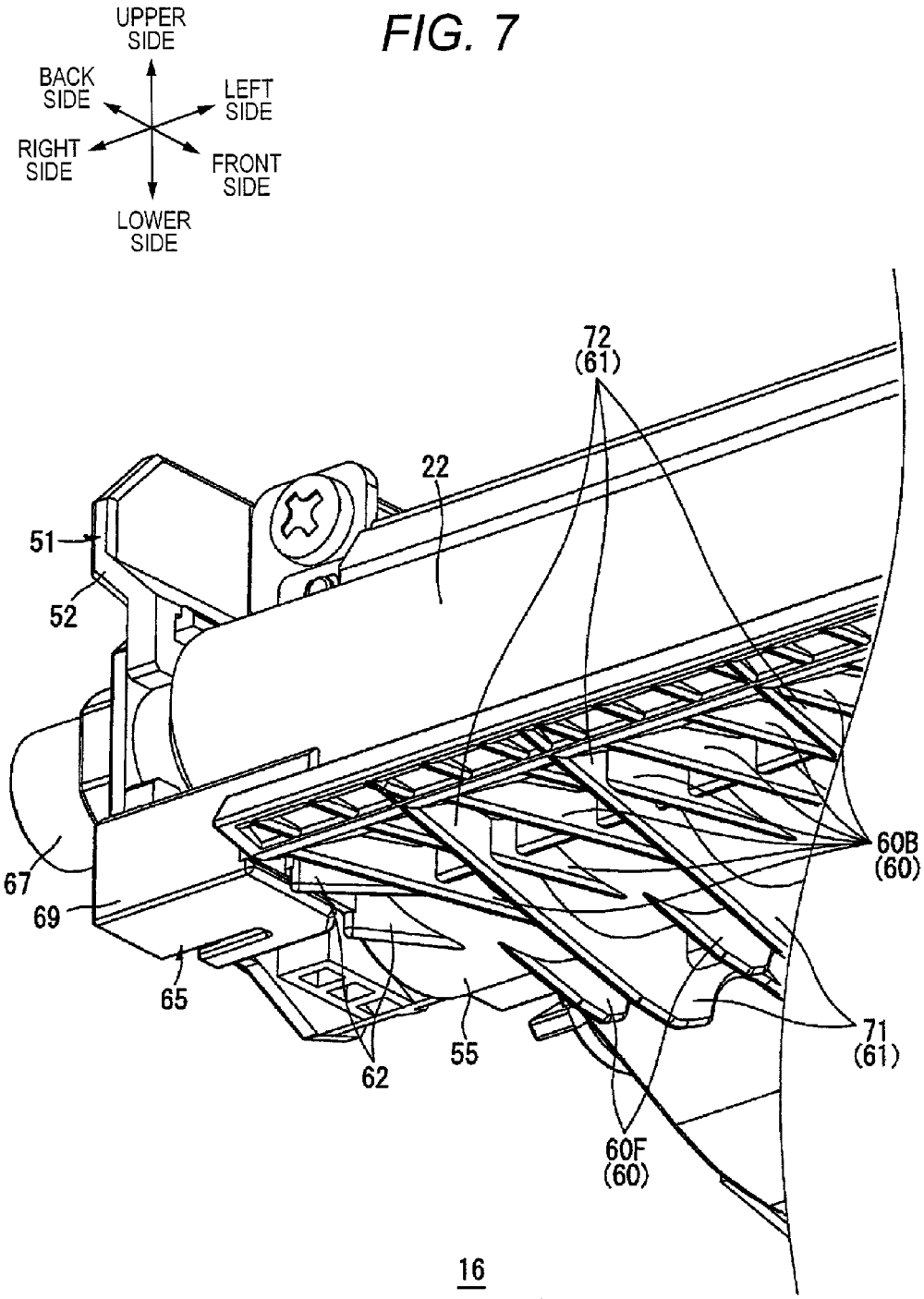
FIG. 7 is a perspective view of the developing cartridge shown in FIG. 1 as seen from a left-lower direction, showing an enlarged view of a right end portion thereof.
Figure 8:
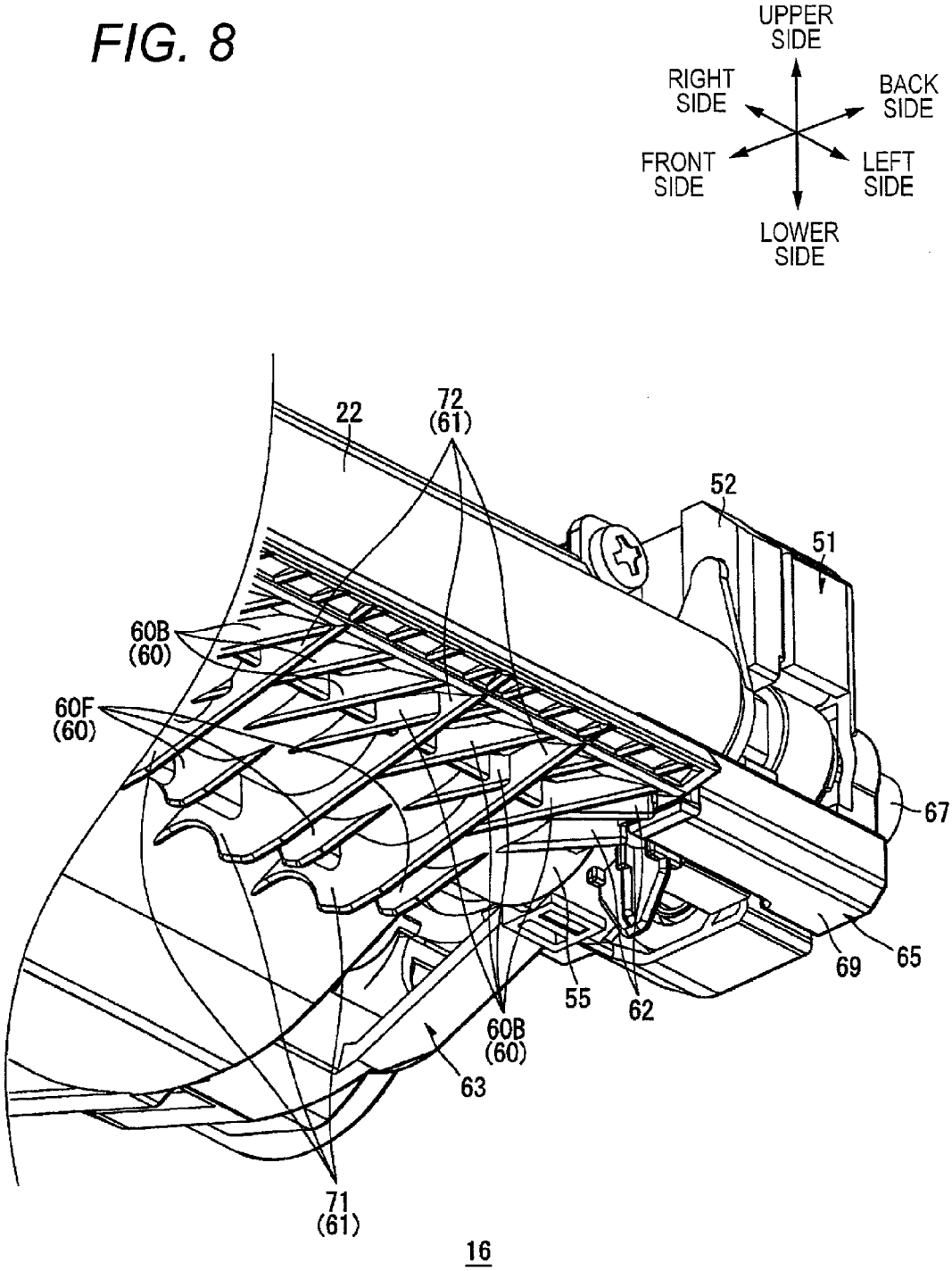
FIG. 8 is a perspective view of the developing cartridge shown in FIG. 1 as seen from a right-lower direction, showing an enlarged view of a left end portion thereof.

As shown in FIGS. 7 and 8, the end ribs 62 are provided rearward from the rear end portion of the supply roller support part 55 (from a further rearward position than the lower end edge of the supply roller support part 55). The front end portions of the end ribs 62 are arranged at positions further rearward than the front end portions of the conveyance ribs 61.

The rear end portions of the end ribs 62 are further protruded downwardly than the rear end portions of the conveyance ribs 61 and are further protruded downwardly than the rear end portions of the toner receiving members 65 provided at the outer sides in the left-right direction of the developing frame 51.

A length of the reinforcement ribs 60 in the upper-lower direction is shorter than those of the conveyance ribs 61 and the end ribs 62. In other words, the reinforcement ribs 60 protrude downwardly so that lower end portions of the reinforcement ribs are arranged at positions further upward than the conveyance ribs 61 and the end ribs 62.

In addition, the reinforcement ribs 60 include a plurality of front side reinforcement ribs 60F, which are provided between the front end portions of the respective conveyance ribs 61, and a plurality of back side reinforcement ribs 60B, which are provided at the back sides of the front side reinforcement ribs 60F.

The front side reinforcement ribs 60F have a substantially linear shape, when seen from a bottom face extending in the front-rear direction. The front side reinforcement ribs 60F include front end portions, which are arranged at slightly further rearward positions of the rear end portion of the toner accommodating part 54 than the front end portions of the conveyance ribs 61, and rear end portions that are arranged at the lower end edge of the supply roller support part 55. Each of the front side reinforcement ribs 60F is provided at a substantial center in the left-right direction between the front end portions of the respective conveyance ribs 61.

The back side reinforcement ribs 60B are arranged in parallel at an interval in the left-right direction between both end ribs 62 of the front side. The back side reinforcement ribs 60B have a substantially linear shape that is inclined toward the outer side in the left-right direction when seen in view along a bottom face toward the rear from the front. Specifically, the back side reinforcement ribs 60B, which are provided at the further rightward positions than the substantial center in the left-right direction of the first frame 52, are rightward inclined toward the rear from the front. Further, the back side reinforcement ribs 60B, which are provided at the further leftward positions than the substantial center in the left-right direction of the first frame 52, are leftward inclined toward the rear from the front. In addition, some of the back side reinforcement ribs 60B are provided to intersect with the conveyance ribs 61.

(3) Attachment and Detachment of Process Cartridge to and from Body Casing (3-1) Attachment and Detachment of Developing Cartridge to and from Drum Cartridge In order to mount the developing cartridge 16 to the drum cartridge 16, a user holds the operation part 57 of the developing cartridge 16 and inserts the rear end portion of the developing cartridge 16 into the developing cartridge mounting part 47 of the drum cartridge 15 from the front-upper side so that the collar parts 67 of the developing cartridge 16 are fitted into the developing roller support grooves 37 of the drum cartridge 15 from the front.

Thus, the developing roller 22 contacts the photosensitive drum 17 from the front side of the photosensitive drum, and the collar parts 67 of the developing cartridge 16 are fitted into the developing roller support grooves 37 of the drum cartridge 15.

Then, the user operates the operation part 57 of the developing cartridge 16 in the lower direction and rotates the developing cartridge 16 about the lower end portion thereof serving as a support point in a clockwise direction, when seen from a left side face.

Thus, the front end portion of the developing cartridge 16 overlaps the front end portion of the drum cartridge 15 from the upper side and the coupling part 66 of the developing cartridge 16 fits into the coupling support grooves 36 of the drum cartridge 15, so that the mounting of the developing cartridge 16 to the drum cartridge 15 is completed.

When the mounting of the developing cartridge 16 to the drum cartridge 15 is completed, the front end portion of the developing cartridge 16 is rearward pressed by a pushing member (not shown) provided at the front end portion of the drum cartridge 15. Thereby, the developing roller 22 press-contacts the photosensitive drum 17.

Figure 9:
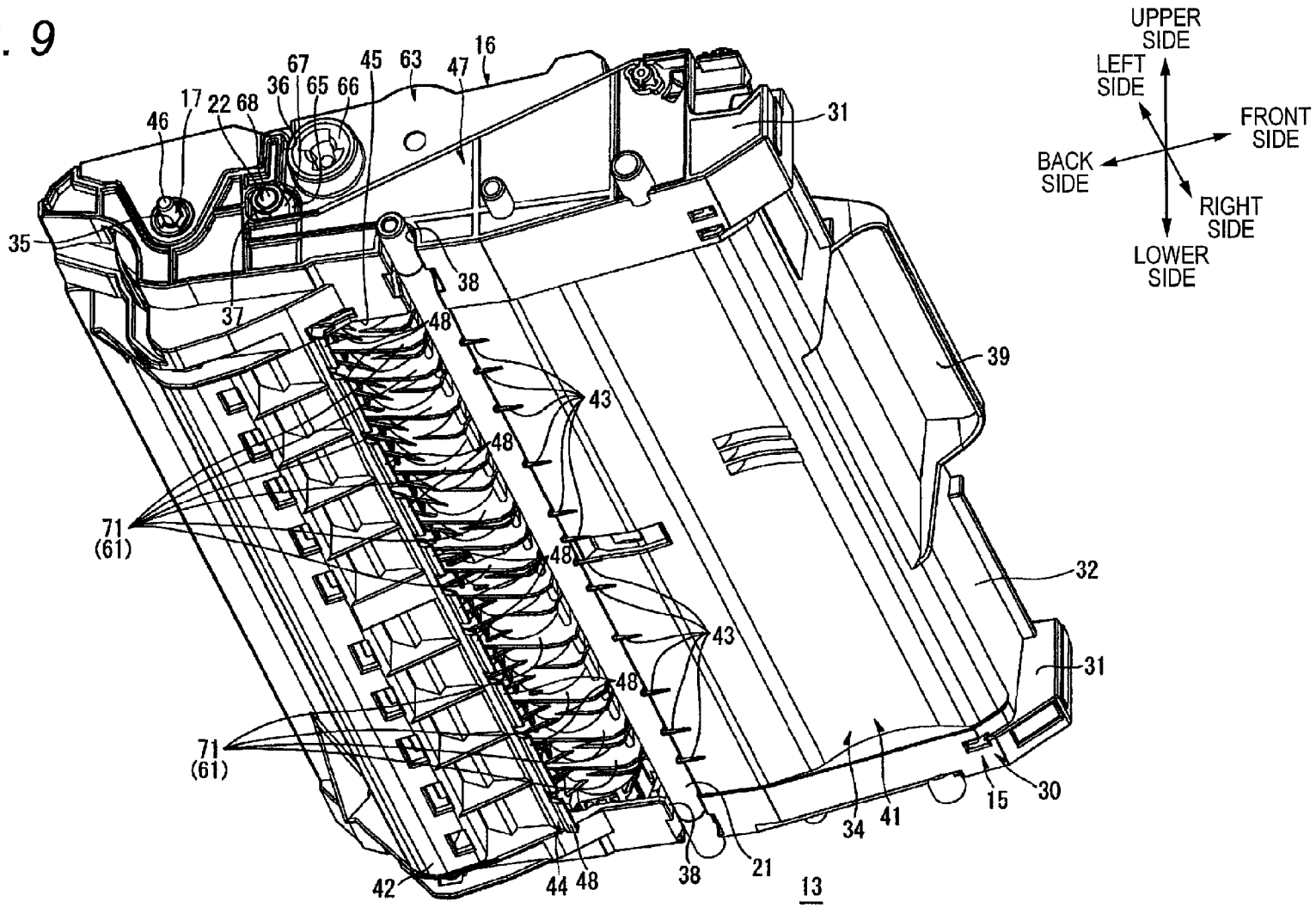
FIG. 9 is a perspective view of the process cartridge shown in FIG. 1 as seen from a left-lower direction.

At this time, as shown in FIG. 9, the front side portions of the conveyance ribs 61 are exposed between the process-side register roller 21 and the sheet conveyance guide 44 so that the front side portions are downwardly protruded through the opening 45 of the drum cartridge 15. In other words, the front side portions of the conveyance ribs 61 serve as the first guide part 71.

The first guide part 71 is arranged at the rear of the process-side register roller 21 and is opposed to the process-side register roller 21 in the front-rear direction.

As shown in FIG. 2, the back side portions of the conveyance ribs 61 continue to the back side of the first guide part 71 and are arranged to be opposite to the sheet conveyance guide 44 separated by a distance in the upper-lower direction. In other words, the back side portions of the conveyance ribs 61 serve as the second guide part 72.

When an imaginary line L is extended along the lower end edge of the second guide part 72, the process-side register roller 21 is arranged above the imaginary line L.

Incidentally, in order to detach the developing cartridge 16 from the drum cartridge 15, the user operates the developing cartridge 16 in a reverse operation to the mounting operation.

That is, the user first holds the handle 39 of the drum cartridge 15 and the operation part 57 of the developing cartridge 16 and operates the operation part 57 of the developing cartridge 16 in the upper direction while pressing the drum cartridge 15, thereby rotating the developing cartridge 16 about the rear end portion thereof, which serves as a support point in a counterclockwise direction, when seen from a left side face.

Then, the user pulls out the developing cartridge 16 in the front-upper direction and separates the developing cartridge from the developing cartridge mounting part 47 of the drum cartridge 15.

(3-2) Attachment and Detachment of Process Cartridge to and from Body Casing

In order to mount the process cartridge 13 to the body casing 2, a user rotates the front cover 5 in the front direction to open the inside of the body casing 2. Then, the user inserts the process cartridge 13 between the scanner unit 12 and the feeder unit 3 from the rear end portion of the process cartridge.

Thus, as shown in FIG. 1, the process-side register roller 21 contacts the main body-side register roller 20 from the upper side thereof and thus the mounting of the process cartridge 13 to the body casing 2 is completed.

At this time, the lower end portion of the process cartridge 13 is opposed to the upper end portion of the feeder unit 3 separated by an interval in the upper-lower direction and the sheet P is conveyed so that the sheet passes between the lower end portion of the process cartridge 13 and the upper end portion of the feeder unit 3 (refer to the dotted line in FIG. 1). In other words, the process cartridge 13 and the feeder unit 3 of the body casing 2 form a conveyance path of the sheet P.

(Conveyance of Sheet)

The sheet P is conveyed one by one from the sheet feeding tray 6 to the nip part between the main body-side register roller 20 and the process-side register roller 21, as described above.

After that, as the main body-side register roller 20 is driven at a predetermined timing, the process-side register roller 21 is thus driven.

Thereby, the sheet P passes between the main body-side register roller 20 and the process-side register roller 21 from the front toward the rear.

The sheet P having passed between the main body-side register roller 20 and the process-side register roller 21 is first contacted to the first guide part 71 from the front side thereof, as shown in FIG. 10A.

Thus, the sheet P is guided toward the rear-lower side along the lower-front end edge of the first guide part 71 and is then introduced between the lower end portions of the conveyance ribs 61 and the upper end portion of the feeder unit 3.

Then, as shown in FIG. 10B, the sheet P passes between the lower end portions of the conveyance ribs 61 and the upper end portion of the feeder unit 3 and is then guided between the second guide part 72 and the sheet conveyance guide 44 by the first guide part 71.

After that, the sheet P is guided between the photosensitive drum 17 and the transfer roller 19 by the second guide part 72 and the sheet conveyance guide 44 so that the sheet P passes between the second guide part 72 and the sheet conveyance guide 44.

In the meantime, when the sheet P is out of line in the left direction during the conveyance of the sheet P, the sheet P is contacted at the left end portion thereof to the left end ribs 62 from the front side when the sheet passes between the second guide part 72 and the sheet conveyance guide 44.

When the sheet P is further conveyed, the left end portion of the sheet P tends to catch on the end ribs 62.

However, since the end ribs 62 protrude further downwardly (to the conveyance path) than the conveyance ribs 61, as shown in FIG. 8, the sheet P is gradually corrected toward the conveyance path (i.e., toward the right side) as it is directed toward the back side.

As the sheet P is further directed rightward toward the back side, the left end portion of the sheet P exits the end ribs 62, and the sheet P is guided to the normal conveyance path (i.e., to the left side).

According to the process cartridge 13, as shown in FIGS. 2 and 9, the conveyance ribs 61 include the first guide part 71 (front side portions of the conveyance ribs 61) and the second guide part 72 (back side portions of the conveyance ribs 61). The first guide part 71 is arranged between the process-side register roller 21 and the sheet conveyance guide 44 in the conveyance direction (front-rear direction) when the developing cartridge 16 is mounted to the drum cartridge 15. The second guide part 72 is continuously provided to the first guide part 71 in the rear direction and is arranged to be opposite to the sheet conveyance guide 44 at an interval in the upper-lower direction when the developing cartridge 16 is mounted to the drum cartridge 15.

When the sheet P is conveyed by the process-side register roller 21, the conveyance ribs 61 first bring the sheet P into contact with the first guide part 71 and then guide the sheet P between the second guide part 72 and the sheet conveyance guide 44 by the first guide part 71.

According thereto, it is possible to convey the sheet P between the photosensitive drum 17 and the developing roller 22 with arranging the process-side register roller 21 and the sheet conveyance guide 44 at an interval in the front-rear direction.

As a result, compared to a case where the sheet conveyance guide 44 is provided adjacent to the process-side register roller 21, it is not necessary to provide the lower wall 34 of the drum cartridge 15 between the process-side register roller 21 and the sheet conveyance guide 44. Thus, it is possible to make the process cartridge 13 smaller (thinner), and to make the printer 1 smaller.

In addition, according to the developing cartridge 13, as shown in FIG. 9, the drum cartridge 15 is formed with the opening 45 between the process-side register roller 21 and the sheet conveyance guide 44. When the developing cartridge 16 is mounted to the drum cartridge 15, the conveyance ribs 61 are protruded toward the lower side through the opening 45, i.e., toward the conveyance path of the sheet P.

According thereto, it is possible to make the process cartridge 13 smaller, as the protruded dimension of the conveyance ribs 61 through the opening 45.

In addition, as shown in FIG. 2, when the imaginary line L is extended along the second guide part 72 of the conveyance ribs 61 by projecting the left-right direction under state in which the developing cartridge 16 is mounted to the drum cartridge 15, the process-side register roller 21 is provided above the imaginary line L (i.e., at the developing cartridge 16 side).

According thereto, the process-side register roller 21 is further protruded downwardly than the conveyance ribs 61 (to the conveyance path), so that it is possible to prevent the process cartridge 13 from being larger.

As a result, it is possible to make the process cartridge 13 smaller.

In addition, according to the process cartridge 13 and the developing cartridge 16, as shown in FIG. 5, when the developing cartridge 16 is mounted to the drum cartridge 15, the first guide part 71 is bent to conform to the outer circumferential surface of the process-side register roller 21 and the front-lower end portion thereof is protruded in the front direction.

Specifically, the protruded portions of the conveyance ribs 61 are downwardly inclined as they are directed toward the back side from the front side.

According thereto, when the developing cartridge 16 is mounted to the drum cartridge 15, the sheet P conveyed by the process-side register roller 21 contacts the process-side register roller 21 and then immediately contacts the front end portions of the conveyance ribs 61.

As a result, it is possible to smoothly give and take the sheet P between the process-side register roller 21 and the conveyance ribs 61, so that it is possible to prevent the sheet P from being jammed between the process-side register roller 21 and the conveyance ribs 61.

In addition, according to the process cartridge 13, as shown in FIG. 3, the process-side register roller 21 is provided in the opening 45 in the front-rear direction.

According thereto, the drum cartridge 15 does not include a member that interferes with the sheet P during the conveyance at the back side of the process-side register roller 21.

As a result, when the developing cartridge 16 is mounted to the drum cartridge 15, it is possible to smoothly give and take the sheet P between the process-side register roller 21 and the conveyance ribs 61.

Additionally, according to the process cartridge 13, as shown in FIG. 9, when the developing cartridge 16 is mounted to the drum cartridge 15, the process-side register roller 21 is opposed to the conveyance ribs 61 in the front-rear direction.

According thereto, it is possible to smoothly give and take the sheet P between the process-side register roller 21 and the conveyance ribs 61 in the front-rear direction.

In addition, according to the printer 1, as shown in FIG. 1, the printer includes the developing cartridge 13 that is made to be small (thin). Thus, it is possible to make the printer 1 small.

Additionally, according to the developing cartridge 16, as shown in FIGS. 5 and 6, the conveyance guide member (rear end portions of the first frame 52), which guides the conveyance of the sheet P, is provided at its both end portions in the left-right direction with the end ribs 62 that are inclined toward the outer side in the left-right direction as they are directed toward the back side and are further protruded downwardly than the conveyance ribs 61.

According thereto, when the sheet P is out of line in the left-right direction during the conveyance, the left and right end portions of the sheet P are first contacted to the end ribs 62 from the back side.

When the sheet P is further conveyed, the left and right end portions of the sheet P tend to get on the end ribs 62. However, since the end ribs 62 are further protruded downward than the conveyance ribs 61, the sheet P is gradually corrected toward the conveyance path as it is directed toward the back side.

As the sheet P is further directed toward the back side, the left and right end portions of the sheet P get out of the end ribs 62 and the sheet P is guided to the normal conveyance path.

Thereby, it is possible to prevent the left and right end portions of the sheet P from contacting the toner receiving members 65.

As a result, even when the sheet P is out of line in the left-right direction, it is possible to convey the sheet P.

In addition, according to the developing cartridge 16, as shown in FIGS. 7 and 8, the end ribs 62 are further protruded downwardly at the rear end portions thereof than the rear end portions of the conveyance ribs 61.

According thereto, it is possible to bring the sheet P conveyed by the conveyance ribs 61 into contact with the end ribs 62 at the back side. As a result, it is possible to prevent the left and right end portions of the sheet P from contacting the toner receiving members 65.

According to the developing cartridge 16, as shown in FIGS. 7 and 8, the front end portions of the end ribs 62 are arranged at the further rearward positions than the front end portions of the conveyance ribs 61.

According thereto, when the sheet P is out of line in the left-right direction, the sheet P is smoothly contacted to the end ribs 62 while being guided by the conveyance ribs 61.

As a result, even when the sheet P is out of line in the left-right direction and is thus contacted to the end ribs 62, the sheet P is smoothly guided to the conveyance path by the end ribs 62 without being caught to the end ribs 62.

In addition, according to the developing cartridge 16, as shown in FIGS. 7 and 8, the end ribs 62 are further protruded downwardly than the toner receiving members 65.

According thereto, it is possible to prevent the sheet P from contacting the toner receiving members 65, more securely.

In addition, according to the process cartridge 13, as shown in FIGS. 2 and 9, the process cartridge includes the developing cartridge 16 that can prevent the sheet P from contacting the toner receiving members 65.

According thereto, it is possible to securely guide the sheet P toward between the photosensitive drum 17 and the transfer roller 19.

What is claimed is:

1. A developing cartridge comprising:

a housing configured to rotatably support a developing roller; and a plurality of conveyance guide members, which are arranged along an axial direction of the developing roller and parallel to each other on an outer side of the housing, and which are configured to guide a recording medium along a conveyance path, wherein the conveyance guide members comprise:

conveyance ribs that extend in a conveyance direction of the recording medium orthogonal to the axial direction of the developing roller so as to protrude from the housing toward the conveyance path of the recording medium; and end ribs, which are provided at both end portions in the axial direction of the developing roller and which are inclined outward with respect to the axial direction of the developing roller toward a downstream side in the conveyance direction, wherein the end ribs protrude from the housing by a first distance and the conveyance ribs protrude from the housing by a second distance that is less than the first distance.

2. The developing cartridge according to claim 1, wherein downstream end portions in the conveyance direction of the end ribs protrude further from the housing into the conveyance path side than downstream end portions in the conveyance direction of the conveyance ribs.

3. The developing cartridge according to claim 1, wherein upstream end portions in the conveyance direction of the end ribs are arranged at positions further downstream in the conveyance direction than upstream end portions in the conveyance direction of the conveyance ribs.

4. The developing cartridge according to claim 2, wherein the end ribs protrude further from the housing into the conveyance path than a member provided at an outer side, in the axial direction, of the developing roller.

5. The developing cartridge according to claim 2, further comprising toner receiving members located at outer side positions, in the axial direction, of the conveyance path, wherein the end ribs protrude further from the housing into the conveyance path side than the toner receiving members.

6. A process cartridge comprising:

an image carrier configured to carry a developer image;

a transfer member, which is opposed to the image carrier, and which is configured to transfer a developer image to a recording medium; and the developing cartridge according to claim 1, wherein the conveyance guide member is configured to guide the recording medium between the image carrier and the transfer member.

7. The process cartridge according to claim 6, further comprising a process-side register roller, which opposes the conveyance ribs in the conveyance direction.

8. The process cartridge according to claim 7, further comprising an opening formed in the process cartridge through which the process-side register roller is exposed.

9. A developing cartridge comprising:

a housing configured to rotatably support a developing roller;

at least one conveyance rib, which protrudes from and extends along an outer side of the housing, and which extends substantially perpendicular to an axis of rotation of the developing roller, to guide a recording medium along the housing; and at least one end rib, which protrudes from an outer side of the housing, and which is located on a portion of the housing located near an axial end of the developing roller, wherein the at least one end rib is inclined at an angle with respect to the axis of rotation of the developing roller so as to approach the axial end of the developing roller as a downstream edge of the housing is approached, and wherein the at least one end rib protrudes from the housing by a first distance and the at least one conveyance rib protrudes from the housing by a second distance that is less than the first distance.

10. A process cartridge comprising:

an image carrier cartridge comprising:

an image carrier, which is located at one end of the image carrier cartridge, and which is configured to carry a developer image; and a transfer member, which is opposed to the image carrier, and which is configured to transfer the developer image to a recording medium; and a developing cartridge comprising a developer carrier, which is located at one end of the developing cartridge and which is configured to carry developer, wherein the developing cartridge is detachably provided to the image carrier cartridge so that the image carrier and the developer carrier are opposed to each other, wherein the image carrier cartridge further comprises:

a conveyance member configured to convey the recording medium between the image carrier and the transfer member; and a first guide member, which is arranged at an interval downstream from the conveyance member in the conveyance direction of the recording medium, and which is configured to guide the recording medium conveyed by the conveyance member between the image carrier and the transfer member, wherein the developing cartridge further comprises a second guide member which, when the developing cartridge is mounted to the image carrier cartridge, is configured to cooperate with the first guide member to guide the recording medium conveyed by the conveyance member between the image carrier and the transfer member, wherein the second guide member comprises:

a first guide part that is arranged between the conveyance member and the first guide member in the conveyance direction when the developing cartridge is mounted to the image carrier cartridge; and a second guide part, which is continuous with the first guide part and is located at the downstream side of the first guide part in the conveyance direction, and which is arranged to be opposite to the first guide member separated by an interval in a direction orthogonal to the conveyance direction when the developing cartridge is mounted to the image carrier cartridge, and wherein when the recording medium is conveyed by the conveyance member, the second guide member is configured to first bring the recording medium into contact with the first guide part and then the first guide part is configured to guide the recording medium between the second guide part and the first guide member.

11. The process cartridge according to claim 10, wherein the image carrier cartridge further comprises an opening, which is formed between the conveyance member and the first guide member, and which is configured to expose upstream parts of the second guide member when the developing cartridge is mounted to the image carrier cartridge, wherein the second guide member comprises conveyance ribs configured to protrude through the opening toward a conveyance path of the recording medium when the developing cartridge is mounted to the image carrier cartridge, wherein upstream parts in the conveyance direction of the conveyance ribs are the first guide part, wherein downstream parts in the conveyance direction of the conveyance ribs are the second guide part, wherein an end portion of the second guide part at the conveyance path side has a substantially linear shape extending along the conveyance direction, and wherein when an imaginary line is extended along the second guide part when viewed from a length direction of the image carrier when the developing cartridge is mounted to the image carrier cartridge, the conveyance member is provided at the developing cartridge side above the imaginary line.

12. The process cartridge according to claim 11, wherein the conveyance member is a conveyance roller extending in the length direction of the image carrier, and wherein the first guide part is bent to conform to an outer circumferential surface of the conveyance roller when the developing cartridge is mounted to the image carrier cartridge, and wherein an end portion of the first guide part at the conveyance path side protrudes toward an upstream side in the conveyance direction.

13. The process cartridge according to claim 11, wherein the conveyance member is located in the opening in the conveyance direction.

14. The process cartridge according to claim 11, wherein the conveyance member is opposed to the conveyance ribs in the conveyance direction when the developing cartridge is mounted to the image carrier cartridge.

15. An image forming apparatus comprising:

the process cartridge according to claim 10; and a body casing, which is configured to house the process cartridge, and which is configured to form a conveyance path of a recording medium together with the process cartridge.

16. A developing cartridge that can be detachably provided to an image carrier cartridge comprising an image carrier carrying a developer image and a conveyance roller conveying a recording medium to the image carrier, the developing cartridge comprising:

a housing;

a developer carrier, which is supported by the housing, and which carries is configured to carry developer; and a plurality of conveyance ribs, which each protrude from the housing toward a conveyance path of the recording medium, and which guide conveyance of the recording medium, wherein end portions of the conveyance ribs at an upstream side in a conveyance direction of the recording medium are bent to conform to an outer circumferential surface of the conveyance roller and protrude toward the upstream side in the conveyance direction of the conveyance path.

17. The developing cartridge according to claim 16, further comprising:

at least one end rib, which protrudes from an outer side of the housing, and which is located on a portion of the housing located near an axial end of the developing carrier, wherein the at least one end rib is inclined at an angle with respect to the axis of rotation of the developing carrier so as to approach the axial end of the developing carrier as a downstream edge of the housing is approached.

* * * * *